US006920741B2

(12) United States Patent
Devine

(10) Patent No.: US 6,920,741 B2
(45) Date of Patent: Jul. 26, 2005

(54) STRAPPING MACHINE WITH QUICK-RELEASE ENCLOSURE DOOR LATCHES

(75) Inventor: Darryl M. Devine, Huntley, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/673,724

(22) Filed: Sep. 29, 2003

(65) Prior Publication Data

US 2004/0098953 A1 May 27, 2004

Related U.S. Application Data

(60) Provisional application No. 60/429,640, filed on Nov. 27, 2002.

(51) Int. Cl.[7] ..... B65B 13/04
(52) U.S. Cl. ..... 53/589
(58) Field of Search ..... 53/589

(56) References Cited

U.S. PATENT DOCUMENTS 5,274,881 A * 1/1994 DeRosa ..... 16/230
5,442,899 A * 8/1995 Shibazaki et al. ..... 53/589
6,233,910 B1 * 5/2001 Hataya ..... 53/589
6,418,838 B1 * 7/2002 Bobren et al. ..... 100/26
6,478,065 B1 * 11/2002 Haberstroh et al. ..... 156/443

* cited by examiner

*Primary Examiner*—John Paradiso
(74) *Attorney, Agent, or Firm*—Mark W. Croll, Esq.; Donald J. Breh, Esq.; Welsh & Katz, Ltd.

(57) ABSTRACT

A strapping machine for positioning a strap material around an associated load, tensioning the strap material and sealing the strap material to itself around the load, includes a frame, a slack box having a slack box cover and a first portion of a strap path having a cover over a portion thereof. A strapping head is mounted to the frame. The strap path cover extends over a portion of the strapping head. The strapping head includes a winder for tensioning the strap material around the load. A chute is mounted to the frame and is configured for positioning the strap material around the load and to release the strap therefrom to pull the strap material to the load. At least one enclosure encloses a portion of the strap path. The enclosure has a door having a quick-release latch. The door has a slot therein and the quick release latch has a projection that is movable across the slot for defining a pintle opening. The projection is movable to define a door pivoting position and a door removal position. The latch includes a release handle for moving the projection out of the slot to define the door removal position for removing the door from the enclosure. The door includes a lower hinge pintle engageable with an opening in the frame.

4 Claims, 21 Drawing Sheets

88
$G_L$
94
124
126
128
L124
$G_N$ 88
130
L130
94
126
S
124
128
L124
L130

STRAPPING MACHINE WITH QUICK-RELEASE ENCLOSURE DOOR LATCHES

CROSS-REFERENCE TO RELATED APPLICATION DATA

This application claims the benefit of priority of U.S. Provisional Patent Application Ser. No. 60/429,640, filed Nov. 27, 2002.

BACKGROUND OF THE INVENTION

The present invention pertains to a strapping machine. More particularly, the present invention pertains to a strapping machine having improved, quick-release enclosure door latches.

Strapping machines are well known in the art. These machines, also referred to as strappers, are used for positioning, tensioning and sealing a strap around a load. The strapping machines are used for a wide variety of objects from piles of lumber to newspapers and magazines to bales of hay and cotton.

Strapping machines are of two types, namely hand-held models and table top models. These machines can be made for use with metal or plastic straps.

In a typical, tabletop plastic strapping machine, the overall machine is mounted to a stationary or moveable worktable. The machine includes, generally, a strap supply, a strapping head, a strap chute and a tabletop or bench to which the components are mounted.

One drawback to known plastic strap tabletop strappers is that the strap path from the supply to and around the chute can be difficult to access. That is, in the even that maintenance is required or that it is necessary to clear a misfed strap along any part of the strap path (from the strap supply to the chute), it is often necessary to disassemble a large portion of the machine, accessing the strap path thought a variety of doors and hatches, in order to clear the machine for proper operation.

Another drawback is that physically, many of these machines are quite large. That is, a relatively large amount of floor space (due to a large foot print) is needed in order for proper operation of the machine and in order to provide sufficient space around the machine to conduct maintenance, repair and the like.

Accordingly, there exists a need for an improved strapping machine having a readily accessible strap path. Desirably, such a strapping machine includes easily cleared, biased slack box guides. More desirably, such a strapping machine includes quick release door latches to provide ready, full access to the strap path. A desirable machine includes double-hinged doors to provide access to the strap path. Such a machine includes a torsion bar/contact tab system to facilitate releasing the strap from the strap chute. More desirably, such a machine includes chute brushes for sequential stripping of the strap from the chute, a limited access head door and drop down roller sets to provide quick and ready access to the strap path and more particularly the strap chute.

BRIEF SUMMARY OF THE INVENTION

A strapping machine for positioning a strap material around an associated load, tensioning the strap material and sealing the strap material to itself around the load, includes a frame, a slack box having a slack box cover and a first portion of a strap path having a cover over a portion thereof. A strapping head is mounted to the frame.

The strap path cover extends over a portion of the strapping head. The strapping head includes a winder for tensioning the strap material around the load. A chute is mounted to the frame and is configured for positioning the strap material around the load and to release the strap therefrom to pull the strap material to the load.

At least one enclosure encloses a portion of the strap path. The enclosure has a door having a quick-release latch. The door has a slot therein and the quick release latch has a projection that is movable across the slot for defining a pintle opening. The projection is movable to define a door pivoting position and a door removal position. The latch includes a release handle for moving the projection out of the slot to define the door removal position for removing the door from the enclosure. The door includes a lower hinge pintle engageable with an opening in the frame.

Preferably, the enclosure door release handle is biased to the move the projection into the slot. The door release handle is mounted to an interior surface of the door and is accessible only with the door in an open position. Preferably, the door release handle is mounted to an upper lip of the door.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying figures, wherein.

DETAILED DESCRIPTION OF THE INVENTION

Figure 1:
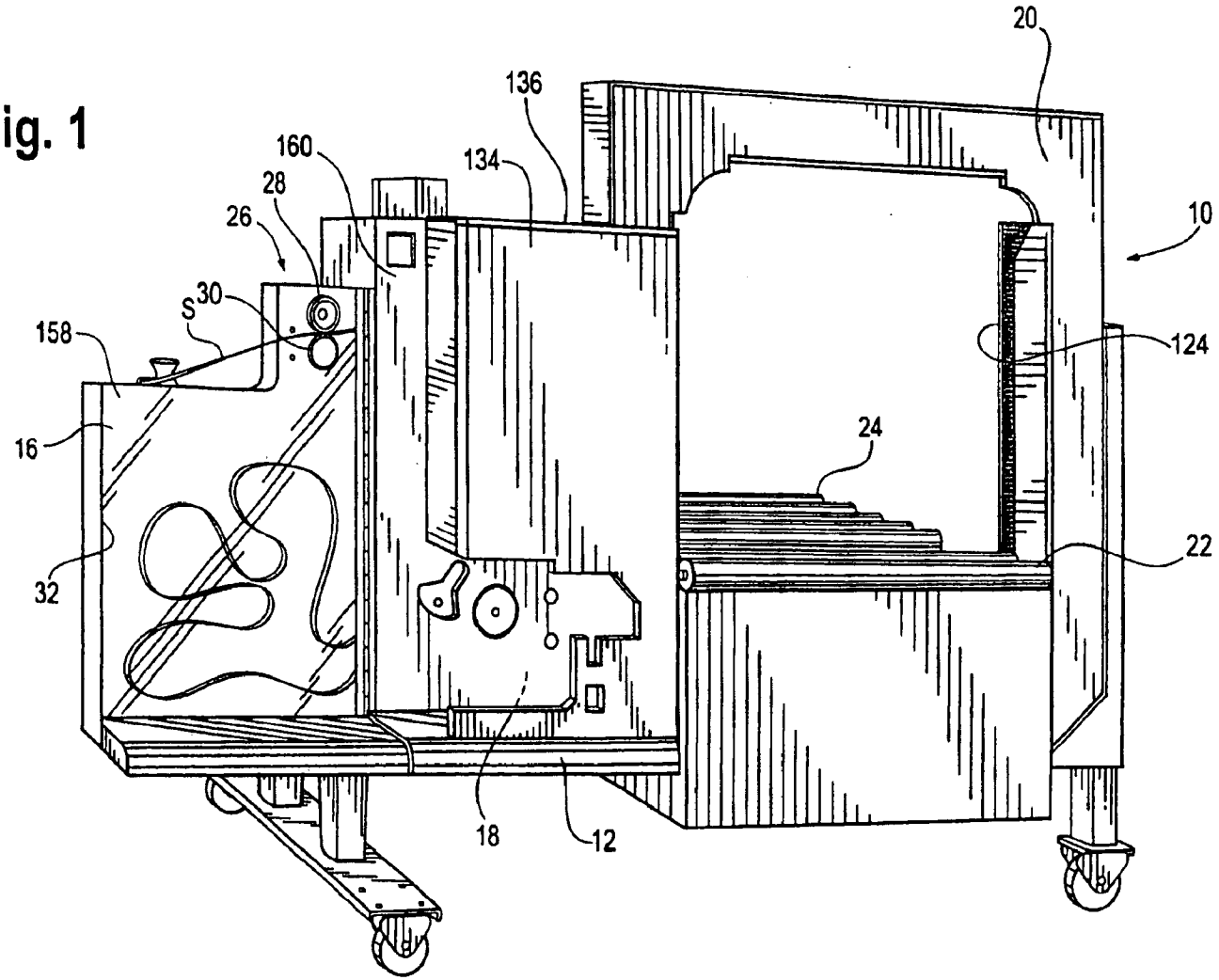
FIG. 1 is a front perspective view of the strapping machine in accordance with the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Figure 2:
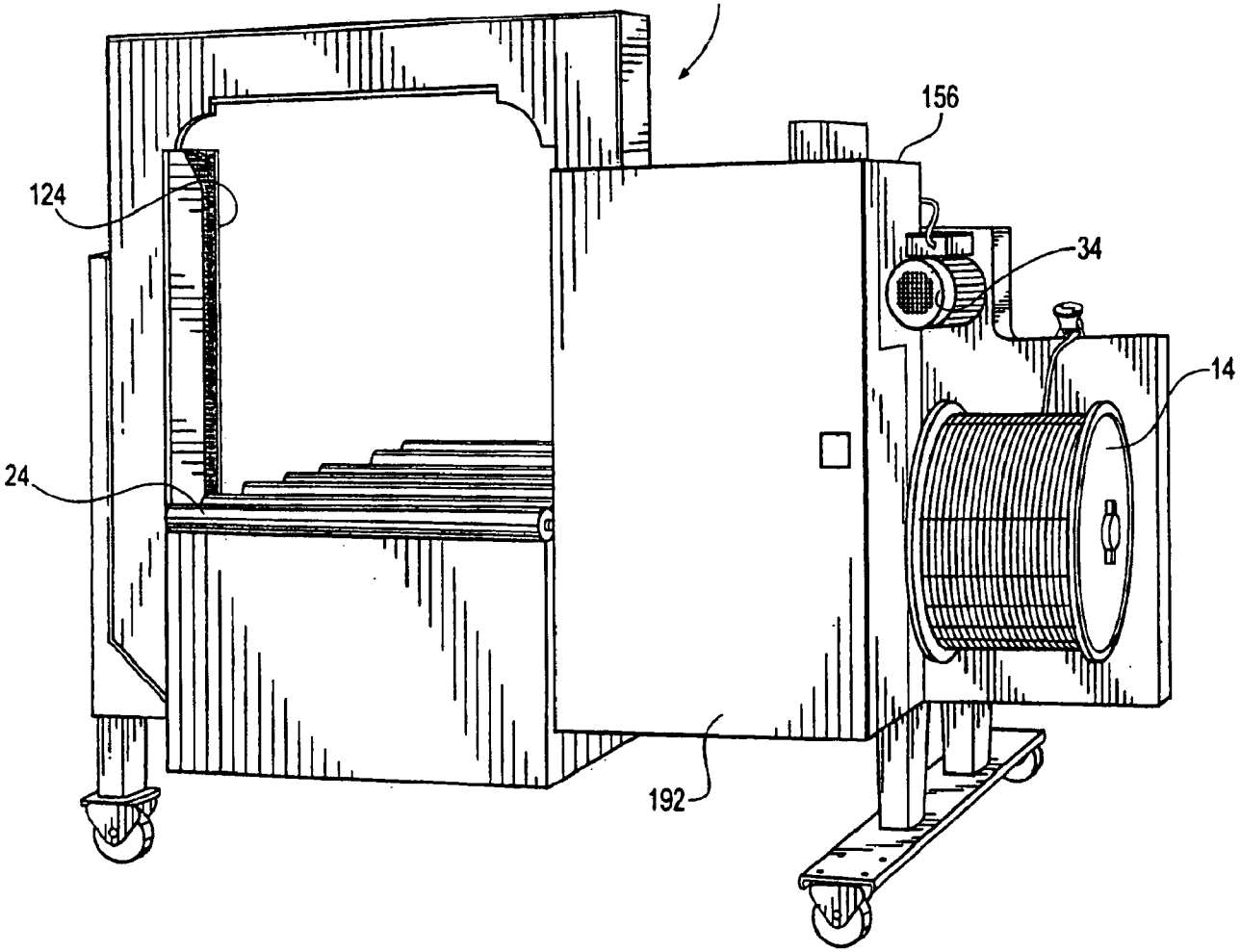
FIG. 2 is a rear perspective view of the strapping machine showing a strap dispenser mounted to the machine.

Referring now to the figures and in particular to FIGS. 1–2, there is shown an improved strapping machine 10 embodying the principles of the present invention. The machine 10 includes, generally, a frame 12, a strap supply such as the illustrated dispenser 14, a slack box 16, a strapping head 18 and a strap chute 20. The machine 10 includes an in-feed roller set 22 and an out-feed roller set 24 for in-feeding and out-feeding the articles or load to be strapped.

The frame 12 supports the strapping machine components. The dispenser 14 can be mounted to the frame 12 as illustrated, or alternately, it can be a separate, stand-alone strap S storage and dispensing unit.

The slack box 16 is also mounted to the frame 12. A feed arrangement 26 pulls strap from the dispenser 14 to feed into the machine 10. The slack box 16 is configured to temporarily store a quantity of strap material S to provide a more consistent flow of strap material from the dispenser 14. The strap S may be stored as a result of take-up from the strapping cycle.

In the present arrangement, the feed arrangement 26 at the slack box 16 includes a driven wheel 30 and an idler wheel 28. A contact switch, indicated generally at 32, located in the slack box 16 actuates a motor 34 to drive the driven wheel 30 to pull strap from the dispenser 14. The contact switch 32 is located along an end of the slack box 16. In this manner, when there is strap S present in the slack box 16 contacting the switch 32, the motor 34 for the driven wheel 30 is stopped. Conversely, when strap S is pulled from the slack box 16 away from the switch 32, the motor 34 is actuated to drive the driven wheel 30 to pull strap material S from the dispenser 14 so that a quantity of strap is present in the slack box 16.

Referring to FIGS. 1 and 3–5, strap traverses from the slack box 16 to the strapping head 18 through a first portion of the strap path indicated generally at 36. The strap path first portion 36 is defined by a pair of opposing, path forming elements or paddles 38, 40 that form the path through which the strap travels from the slack box 16 to the strapping head 18. The paddles, which are inner 38 and outer 40 paddles, move toward and away from each other. Movement of each paddle 38, 40 is independent of the other paddle. The paddles 38, 40 define a strap path entrance 42, near the slack box 16, and a strap path exit 44.

Figure 5:
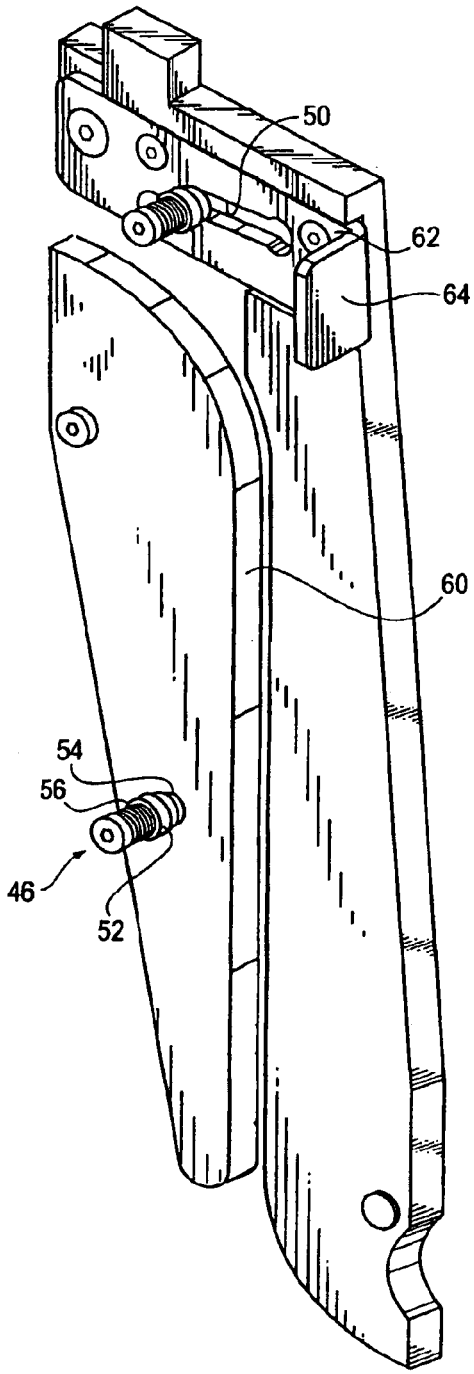
FIG. 5 is a perspective view of the strap path paddles in the open path position.

Unlike known strap paths, this paddle 38, 40 arrangement provides ready access to the strap path 36 for clearing strap or debris therefrom. The paddles 38, 40 are mounted to the machine 10 by biased locking pin assemblies 46 (one shown on the inner paddle 38). Referring to the inner paddle 38, this paddle 38 is pivotally mounted to the frame 12 at a pivot pin 48. The biased locking pin assembly 46 is mounted to the frame 12 through an elongated notched opening 50 in the paddle 38. As illustrated, a locking pin assembly 46 is shown mounting the inner paddle 38 to the frame 12. The notched opening permits pivoting the inner paddle 38 (about the pivot pin 48) between a closed chute position (FIG. 4) and an open chute position (FIG. 5). The pivot 48 is spaced from the locking pin 46.

A collar 52 is fitted around a pin 54, which collar 52 locks into the paddle opening 50. By pulling the collar 52 outwardly against the biasing element, e.g., spring 56, the paddle 38 is unlocked and can be pivoted with the pin portion 54 of the locking pin assembly 46 traversing through the notched opening 50. In the closed path position, the paddle 38 is locked in place by the collar 52 fitting into an enlarged portion 58 of the elongated opening 50. By pulling the collar 52 outwardly, away from the paddle 38, the collar 52 is released from the paddle 38 and the paddle 38 can be pivoted such that the pin portion 54 traverses through the elongated opening 50. The inner paddle 38 is thus moved to the open chute position.

The outer paddle 40 is likewise pivotally mounted to the frame 12 (by a pivot pin 58) and includes the locking pin 46 arrangement. The outer paddle pivot pin 58 is positioned at about the strap path exit 44. In this manner, when both the inner 38 and outer 40 paddles are moved to the open path position, sufficient space, indicated generally at 60, is provided between the paddles 38, 40 (in the otherwise constricted strap path 36) to permit clearing any misfed strap or debris from the strap path.

The locking pin on the outer paddle 40 is mounted to the paddle 40 over a slide flange 62. The flange 62 includes a gripping region 64 to facilitate readily pulling the collar with one hand while urging the outer paddle 40 open using the slide flange 62 with the other hand. In that the outer paddle 40 is biased toward the closed path position, the flange 62 (and griping region 64) facilitates readily moving the paddle 40 to open the strap path 36.

Figure 3:
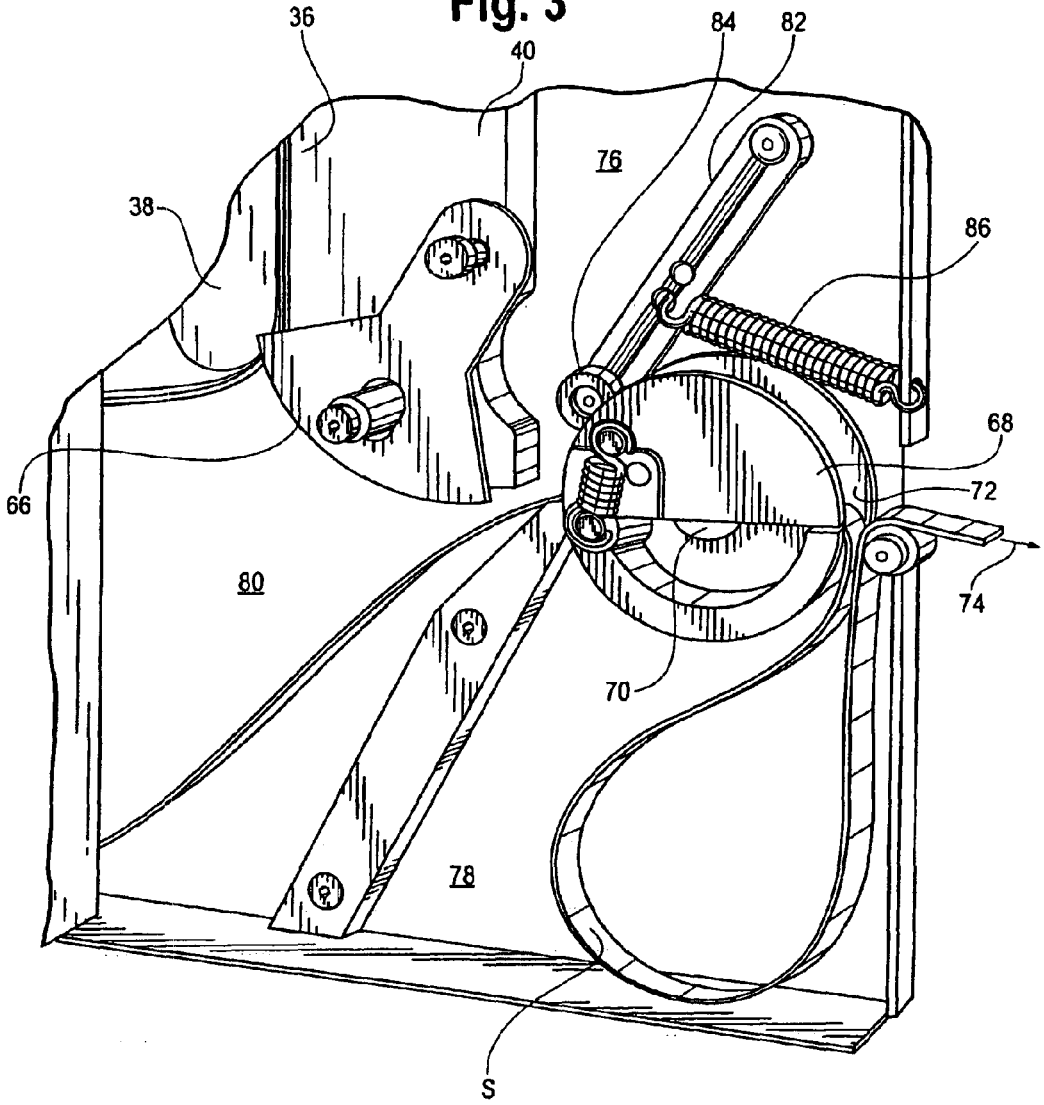
FIG. 3 is front view of the machine showing the bottom portion of the strap path paddles, the turning element and the winder and biased winder arm at the inlet to the strapping head.
Figure 4:
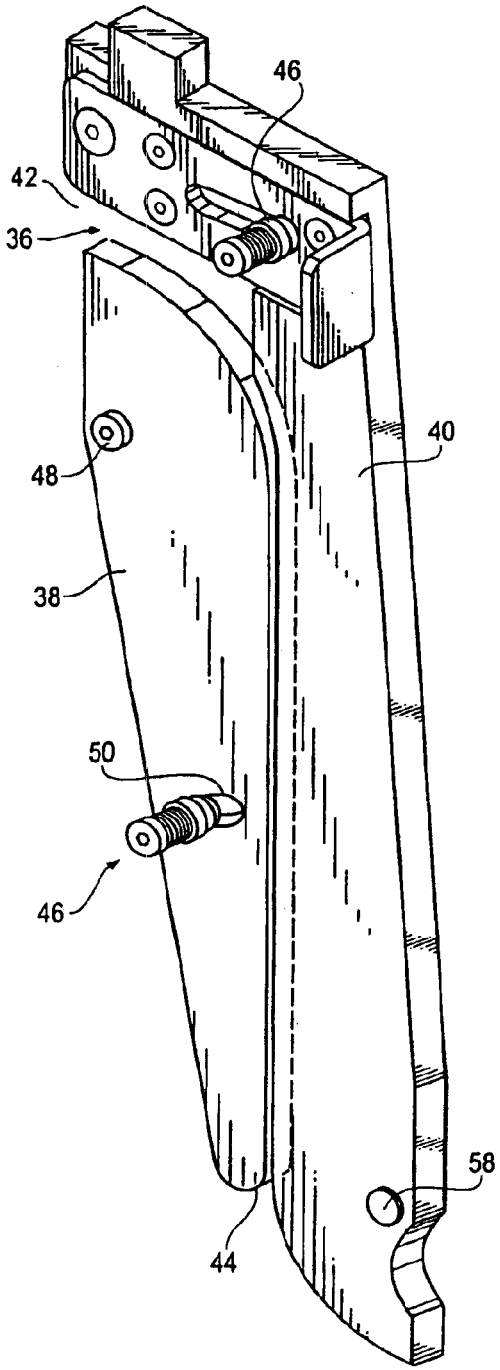
FIG. 4 is a perspective view of the strap path, showing the strap path forming paddles in the closed path position.

Referring to FIGS. 1 and 3, at a lower portion of the strap path 36, below the paddles 38, 40, at the strap path exit 44, a turning element 66 directs the strap S toward the strapping head 18. A winder 68 is positioned at the inlet of the strapping head 18. The winder 68 is that element through which the strap S traverses, that rewinds or tensions the strap S after it is positioned around a load and the leading edge of the strap is grasped. The strap S traverses through a central, slot-like opening 70 in the winder during the feeding operation and, during the tensioning operation, the winder 68 rotates so as to pull or tension the strap S around the load. As the winder 68 rotates, it will be appreciated that it is "pulling" strap S both from the load as well as the slack box 16, and consequently the "pulled" strap material S winds around an outer periphery 72 of the winder 68.

When the rewinding or tensioning step is complete (and after sealing the strap onto itself), the rewinder 68 must counter-rotate to position the central slot-like opening 70 along the strap path (e.g., in a straight-line path from the turning element 66 to the inlet to the feed and tension wheels indicated generally by the directional arrow at 74). During this counter-rotation, the strap S that was wound about the periphery 72 of the winder 68 (during tensioning) would otherwise tend to collect in regions above and below the winder 68 (as indicated at 76 and 78). Subsequent to this counter-rotation, the feed mode is re-instituted and strap S is pulled through the strap path 36 into the strapping head 18. It has, however, been found that because these regions above and below the winder can be rather restricted in size and constricted (as to ingress and egress), the strap S can tend to become caught in these regions and twist or otherwise cause misfeed of the strapping machine.

To this end, the present strapping machine 10 includes a region, indicated generally at 80 (i.e., toward and into the 16 slack box) into which this "loose" strap is directed during counter-rotation of the winder 68. In order to direct the strap into this region, a biased winder arm 82 is positioned near the winder 68, one end of which includes a roller 84 that rests or rides along the outer periphery 72 of the winder 68. The 82 arm is biased, such as by a coil spring 86, to urge the roller 84 into contact with the strap wound on the winder outer periphery 72. In this manner, as the winder 68 counter-rotates, the strap S is directed to a single region 80, preferably below the winder 68 (toward and into the slack box 16), that is configured for temporarily "storing" the strap S that is unwound from the winder 68, with reduced opportunity for tangling. Strap can thus be directed to a region 80 that has minimized restrictions to provide a free-flowing feed of strap material S to the strapping head 18.

As will be recognized and appreciated by those skilled in the art, the strapping head 18 is configured to feed a leading end of the strap into the strap chute 20 so that the leading end of the strap S traverses around the strap chute 20 and back to the strapping head 18. When the leading end of the strap is received in the strapping head 18, it is gripped, at which time the strap feed stops. The strap S is then retracted and the winder 68 is actuated to begin tensioning the strap S. During retraction (or take-up), the strap S is released from the strap chute 20 so that continued rewinding operation strips or pulls the strap S from the chute 20. As the strap S is stripped from the chute 20, it is pulled to and around the load such that continued rewinding tensions the strap S around the load. When a predetermined tension is reached, the winder 68 stops counter-rotation and the strap S is sealed (e.g., welded) onto itself and subsequently cut from the supply or trailing end.

Referring to FIGS. 16–24, in the present strapper 10, the strap chute 20 is formed from inner and outer movable chute walls 88, 90, respectively. The inner and outer walls 88, 90 are radially spaced from one another to define a track, space or path, indicated generally at 92, between the walls 88, 90 through which the strap S traverses. The chute 20 also includes a transverse or side wall 94 that keeps the strap S within the space 92 between the inner and outer walls 88, 90. During the stripping operation, the movable chute walls 88, 90 are moved in a longitudinal direction (see FIG. 20) so as to essentially move the walls 88, 90 away from the strap S as it is stripped from the chute 20 and pulled toward the load. The strap S is stripped from the chute 20 and is pulled though a gap, indicated at 96, that is defined between the (stationary or fixed) transverse wall 94 and the (movable) chute inner and outer walls 88, 90 when the walls 88, 90 are longitudinally moved.

The inner and outer walls 88, 90 are mounted to one another at a plurality of corner supports 98. The corner supports 98 maintain the walls 88, 90 positioned relative to one another and maintain the space (between the walls 88, 90) for the track 92. The inner and outer walls 88, 90 are mounted to the chute outer housing 100 at the corner supports 98 by biased pin assemblies 102.

Stationary stripping elements 104 extend through the corner supports 98 and the inner and outer walls 88, 90. The stripping elements 104 contact the strap S as the inner and outer walls 88, 90 are pulled away from the transverse (side) wall 94 (during the stripping operation) which urges the strap S into the gap 96 between the transverse wall 94 and the movable walls 88, 90.

In a present embodiment, to effect movement of the chute walls 88, 90, a first torsion element 106 extends upwardly in a vertical manner between the outer chute wall 90 and the chute housing 100. The first torsion element 106 is formed from a steel rod or like element. A pin 108 extends radially through the first torsion element 106 at an upper end thereof. A second torsion element 110 is positioned at about a top of the strap chute 20 and extends horizontally therealong. The second torsion element 110, likewise includes a radially extending pin 112 therethrough that is configured and positioned to cooperate with the pin 108 in the first element 106. In this manner, as the first torsion element 106 is twisted or rotated, the pin 108 likewise rotates, contacting the second element pin 112 which in turn twists and/or rotates the second element 110. A third torsion element 114 extends along an opposite, vertical side of the strap chute 20 and likewise is adapted to cooperate with the second torsion element 110 by a radially extending pin therein 116. A fourth torsion element 118 extends horizontally along a bottom side of the chute 20, likewise cooperating by use of the torsion pins.

Each of the torsion elements 106, 110, 114, 118 includes a plurality of fingers or contact tabs 120 mounted thereto.

The contact tabs 120 are configured to engage and push the movable strap chute walls 88, 90 as the torsion elements 106, 110, 114, 118 are twisted. In this manner, twisting the first torsion element 106 results in twisting of the second 110, third 114 and fourth 118 elements, the contact tabs 120 of which engage the movable chute walls 88, 90, longitudinally moving the walls 88, 90 from the strap S. The first torsion element 106 is actuated (e.g., twisted) by a camming element 122 (see FIGS. 16–17) driven as part of the strapping head 18 operation. Those skilled in the art will appreciate and understand that there are various other configurations by which the strap chute 20 can be mounted to the machine 10 and various other configurations by which the chute 20 can be moved or displaced so as to permit the strap S to fall to and tension around the load, which other configurations are within the scope and spirit of the present invention. In one contemplated arrangement, meshing bevel gears can be mounted to the torsion elements to effect cooperative rotation of the elements.

It will also be appreciated by those skilled in the art, that when the strap S is released from the strap chute 20 and as the winder 68 counter-rotates to rewind or tension the strap S, there exists the potential for the strap to "fly" out of the strap chute 20 and twist as it is pulled toward the load. In order to prevent such twisting, the present strapping machine 10 includes a plurality of brushes 124 (best seen in FIGS. 1–2 and 25*a* and 25*b*) that are positioned between the strap chute 20 and the load. These brushes 124 extend across the "stripping" path of the strap to restrict release of the strap S as it exits the strap chute 20 and is pulled toward the load. The brushes 124 are positioned such that a gap 126 is defined between the end of the brush 124 (or the end of the bristles, as indicated generally at 128) and the side of the strap chute (that is, the side or transverse wall 94). The brush 124 and gap (or overhang) 126 are configured to sequentially release the strap S from the chute 20.

Figures 25A, 25B:
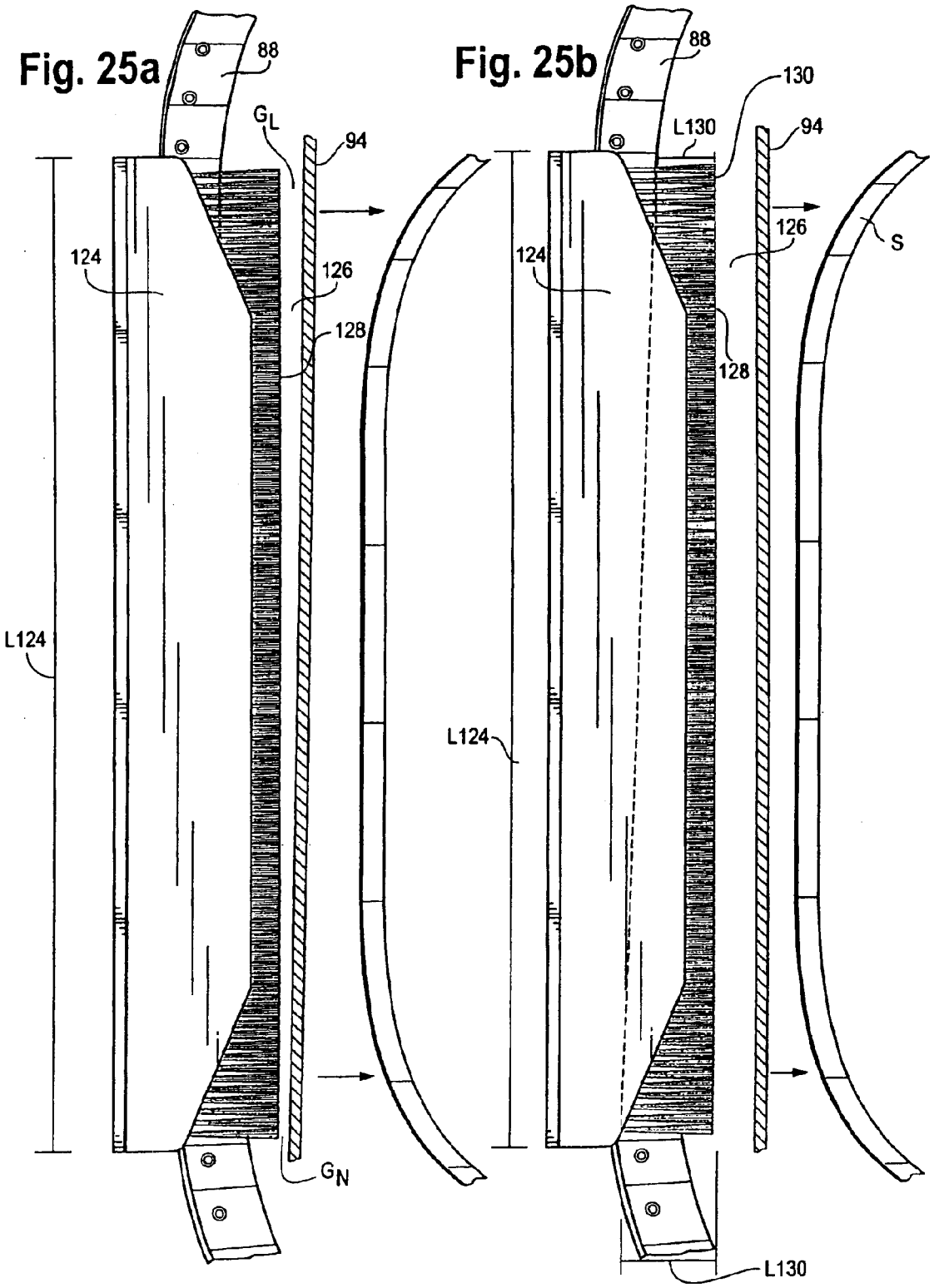
FIGS. 25*a* and 25*b* are a schematic representations of chute brush configurations for sequentially stripping strap from the strap chute, FIG. 25*a* showing a varying gap width configuration and FIG. 25*b* showing a varying exposed bristle length configuration.
Figure 26:
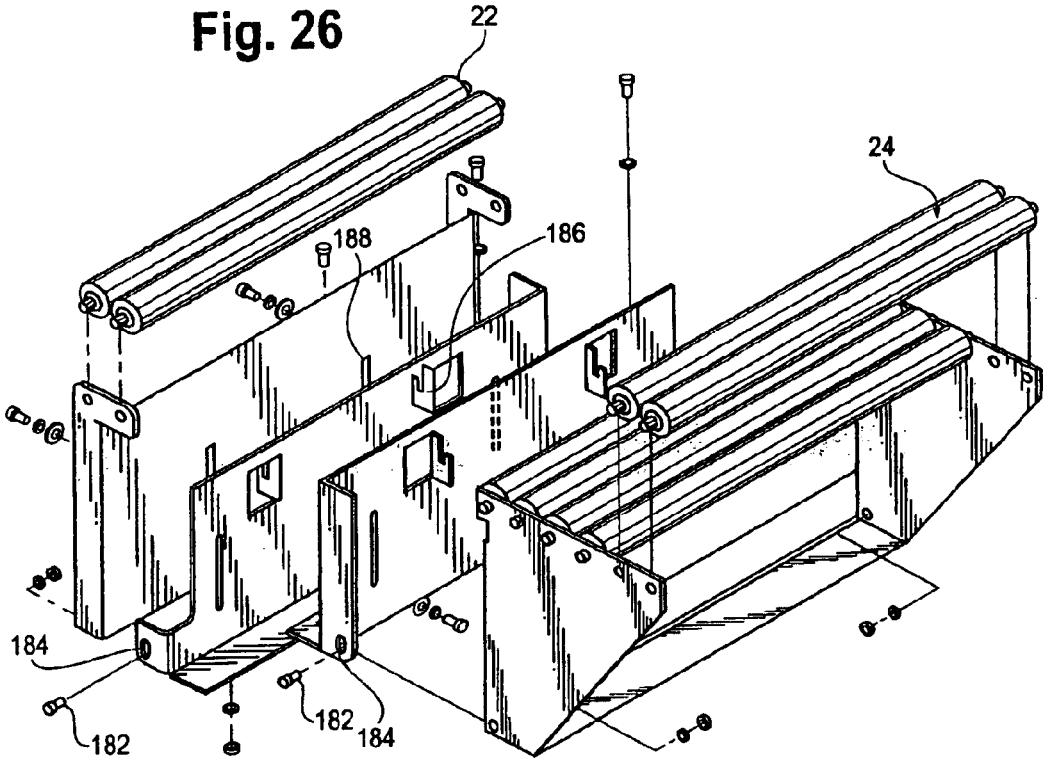
FIG. 26 is an exploded view of the infeed and outfeed roller sets positioned on either side of the strap chute (the strap chute being removed for easy of viewing)
Figure 27:
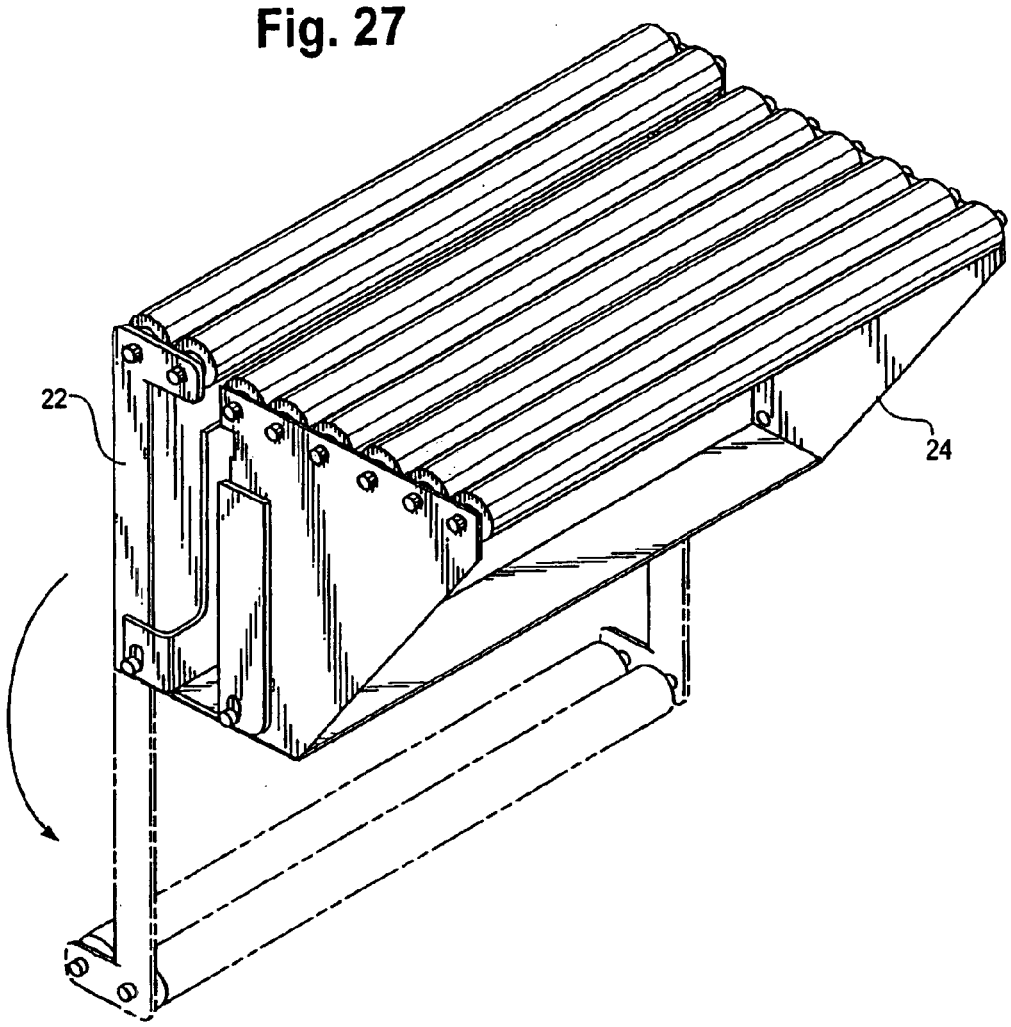
FIG. 27 is a view of the roller set of FIG. 26 showing the infeed roller set, in phantom lines, pivoted downwardly from the operating position.
Figure 28:
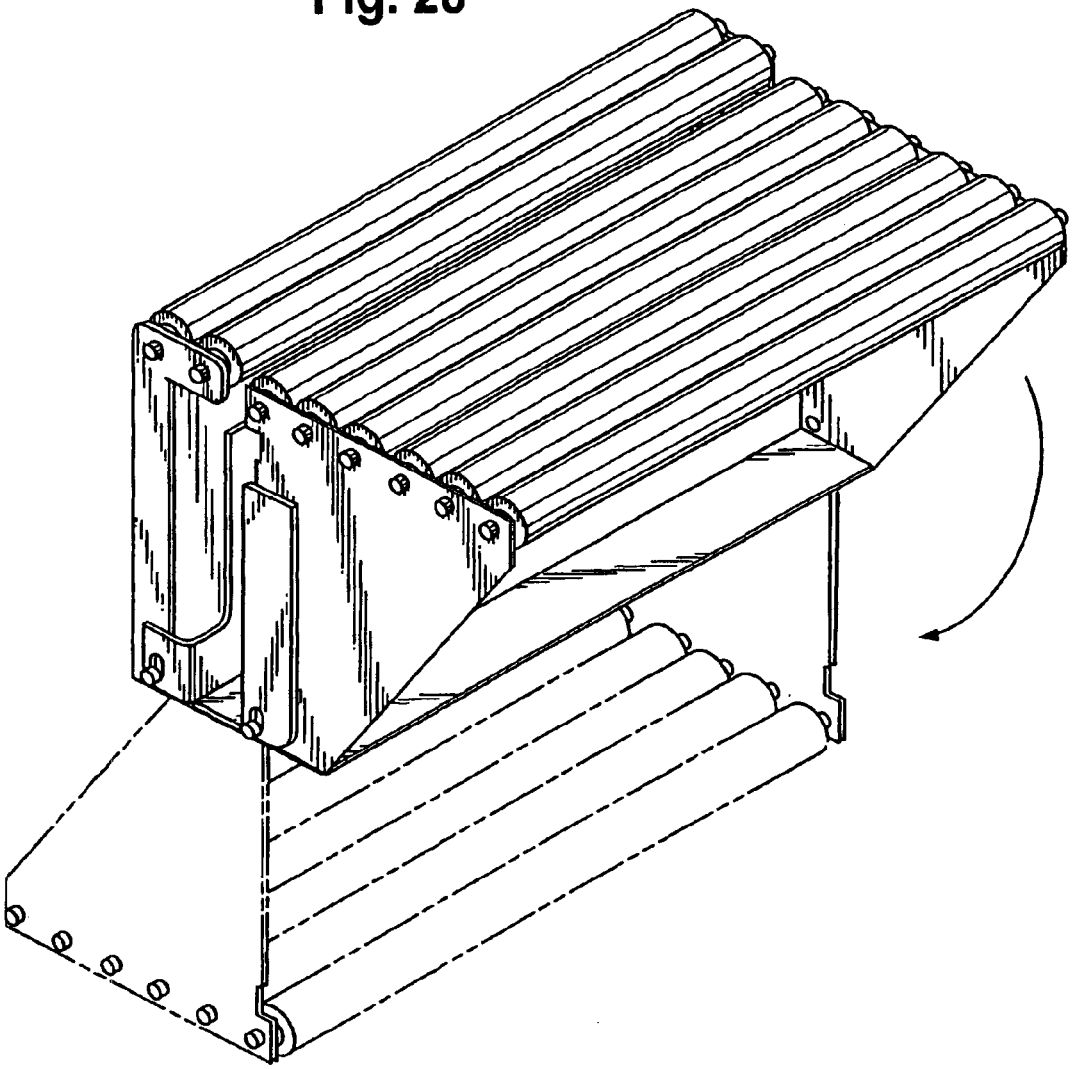
FIG. 28 is a view of the roller set of FIG. 26 showing the outfeed roller set, in phantom lines, pivoted downwardly from the operating position.

Referring to FIG. 25*a*, in one embodiment, the brush 124 is positioned such that the size or width of the gap 126 varies along the length $L_{124}$ of the brush 124. That is, the brush 124 is positioned such that the gap 126 between the brush end 128 and the side wall 94 varies between a largest gap $G_L$ where it is desired for the strap S to exit the chute 20 first and narrows to a narrowest point $G_N$ at that location at which it is desired for the strap S to exit the chute 20 last. In this manner, the chute brushes 124 provide for sequential stripping of the strap S from the chute 20. It has been found that this sequential stripping reduces the opportunity for the strap S to twist as it exits the strap chute 20 and is tensioned around the load.

Alternately, as seen in FIG. 25*b*, the brush 124 can be configured such that the length $L_{130}$ of the bristles 130 is varied along the length $L_{124}$ of the brush 124 while the gap 126 between the end of the bristles 128 and the chute wall 94 is maintained relatively constant. This too, it is believed, will provide for sequentially stripping the strap S from the chute 20 due to the varied resistance of the stiffer (shorter) bristles compared to the softer (longer) bristles. Other arrangements for sequentially stripping strap S from the chute 20 will be recognized and appreciated by those skilled in the art and are within the scope and spirit of the present invention.

To provide maximum operator access to the strap path 36 and the strapping head 18 while minimizing the opportunity for an operator to access moving or driven parts of the strapping machine 10 during operation, the present strapping machine 10 includes a plurality of operator accessible doors or hatches to facilitate "light" maintenance on the strapping machine 10, such as dislodging misfed strap or clearing debris.

A first such arrangement includes one or more quick release door latches 132, such as that illustrated in FIGS. 8–11. One such latch 132 is positioned on a door 134 that encloses the first portion of the strap path 36 and a portion of the strapping head 18. Such a door 134 is mounted to an enclosure 136 mounted to the frame 12 at upper and lower door pintles 138. These pintles 138 extend downwardly from an upper portion of the enclosure 136 and upwardly from a lower portion of the enclosure 136. A lower edge of the door includes an opening into which the pintle is fitted (not shown). An upper edge 140 of the door 134 includes an elongated slot 142 extending in generally the same direction as (e.g., coplanar with) the face or plane of the door 134.

A biased latch 144 is positioned on the door 134, within the enclosed portion (that is accessible only when the door 134 is open), which latch 144 includes a pivot pin 146, a hinge-forming projection 148 and a release handle 150. The latch 144 is pivoted between an open position (FIG. 10) in which the hinge-forming projection 148 is moved out of the door slot 142 and a closed position (FIG. 11) in which the projection 148 extends transverse to and across the slot 142 to essentially form a hinge opening 152 into which the pintle 138 fits. In this manner, when the latch 144 is in the closed or locked position, an enclosed opening 152 is formed around the pintle 138 to permit pivoting the door 134.

The door 134 is readily removed from the enclosure 136 by depressing the release handle 150 to move the latch 144 into the open position, thus moving the projection 148 out of the pathway of the slot 142. The door 134 can then be slid off of the upper and lower pintles 138, thus fully removing the door 134 from the enclosure 136. To maintain the latch 144 in the closed position, the latch 144 is biased to the closed position by, for example, a spring 154 (shown in phantom lines in FIG. 11). Such a quick release door latch arrangement 132 is likewise used on other portions of the strapping machine 10 to provide ready access to these user-accessible parts of the strapping machine 10.

To further permit ready access to portions of the strapping machine 10, the machine 10 includes a double-hinged slack box door 158 and head door 160, as illustrated in FIGS. 12–15. These double-hinged doors 158, 160 employ a single hinge 162 that allows separate and independent functioning of the doors 158, 160, one of which encloses the slack box 16 and the other of which encloses the first portion of the strap path 36 and a portion of the strapping head 18.

The single, vertically oriented piano-type hinge 162 extends between upper and lower stationary portions 164, 166 of the frame 12. The slack box door 158 is mounted to one flange of the hinge 162 while the head cover door 160 is mounted to the other flange of the hinge 162. In this manner, both doors 158, 160 can be opened at the same time as well as each independent of the other.

In the present arrangement, the head cover door 160 includes a floating guide 168 mounted thereto. The guide 168 forms a portion of the strap path at the strapping head 18 from the winder 68 into the strapping head feed wheels (not shown). By mounting the guide 168 on the head cover door 160, rather than as a separate element within the strapping head (which is commonly known) the strap path through the strapping head 18 is more readily accessible. The guide 168 is mounted to the cover door 160 so as to "float" and is properly positioned when the door 160 is closed by aligning pins 170 that extend outwardly from fixed structural portions (not shown) of the strapping head that align with (fit into) openings 172 in the guide 168. An exemplary arrangement is disclosed in Haberstroh, et al., U.S. Pat. No. 6,478,065, which patent is commonly assigned herewith and incorporated herein by reference.

The strapping head cover door 160 is interlocked with the feed wheel drive arrangement. In such an interlocked arrangement, a key 174 mounted on the door 160 fits into an opening in a lock 176 that is mounted to the strapping head 18. When the key 174 is removed from the lock 176, as by opening the door 160, power to the strapping head feed wheels is isolated so that the feed wheels will not rotate. This provides enhanced personnel safety features to reduce the opportunity for operator exposure to rotating or driven parts.

The head cover door 160, which overlies a portion of the strap path 36 and the strapping head 18, includes openings 178 therein through which the paddle locking pin assemblies 46 extend, and through which the winder 68 can be accessed. In this manner, the paddles 38, 40 can be operated and the winder 68 accessed with the head cover 160 closed in that these operations may be necessary for clearing the strap path.

The door 160 also includes an opening 180 through which a strap ejection chute (not shown) extends. As will be appreciated by those skilled in the art, misfed strap can be automatically ejected from the strapping head 18 and strap refeed automatically carried out following a misfed strap. In that this operation is performed automatically and without operator intervention, it is desirable to eject the strap to an area outside of the machine. Thus the ejection chute extends outside of the machine enclosures for fully automated, continual machine operation.

The present strapping machine further includes enhancements to the load carriage portions of the machine 10. As illustrated in FIGS. 1–2 and 26–28, the machine 10 includes in-feed and out-feed rollers 22, 24 to facilitate in feed and out feed of the load from the machine 10. These roller sets 22, 24 are mounted to the strapping machine 10 in order to provide a more compact, self-standing unit.

In that much of the machine 10 has been configured to reduce the overall space needed for the machine footprint, a novel arrangement for mounting the roller sets 22, 24 to the machine 10 is used. Each the in-feed and out-feed side roller sets 22, 24 are mounted to the machine 10 so as to pivot upwardly into an operating position and downwardly away from the chute 20 and the head 18 enclosure to permit ready maintenance of the machine 10. The present arrangement includes pivot pins 182 mounted to either the roller sets 22, 24 or the machine frame 12 that cooperate with notched openings 184 formed in the machine frame 12 or the roller sets 22, 24. The frame 12 includes upwardly extending hook elements 186 that are configured for insertion into slots 188 in the roller sets 22, 24. In this manner, the roller sets 22, 24 are pivoted upward and are then lifted so that the hook elements 186 insert into the roller set slots 188. The roller sets 22, 24 are then lowered, to lock the sets 22,24 onto the frame 12. Such an arrangement is used on both the in-feed and out-feed roller sets 22, 24 to permit readily pivoting the roller sets 22, 24 outwardly, away from the frame 12 for access to the chute 20 and head 18 enclosure.

Figure 6:
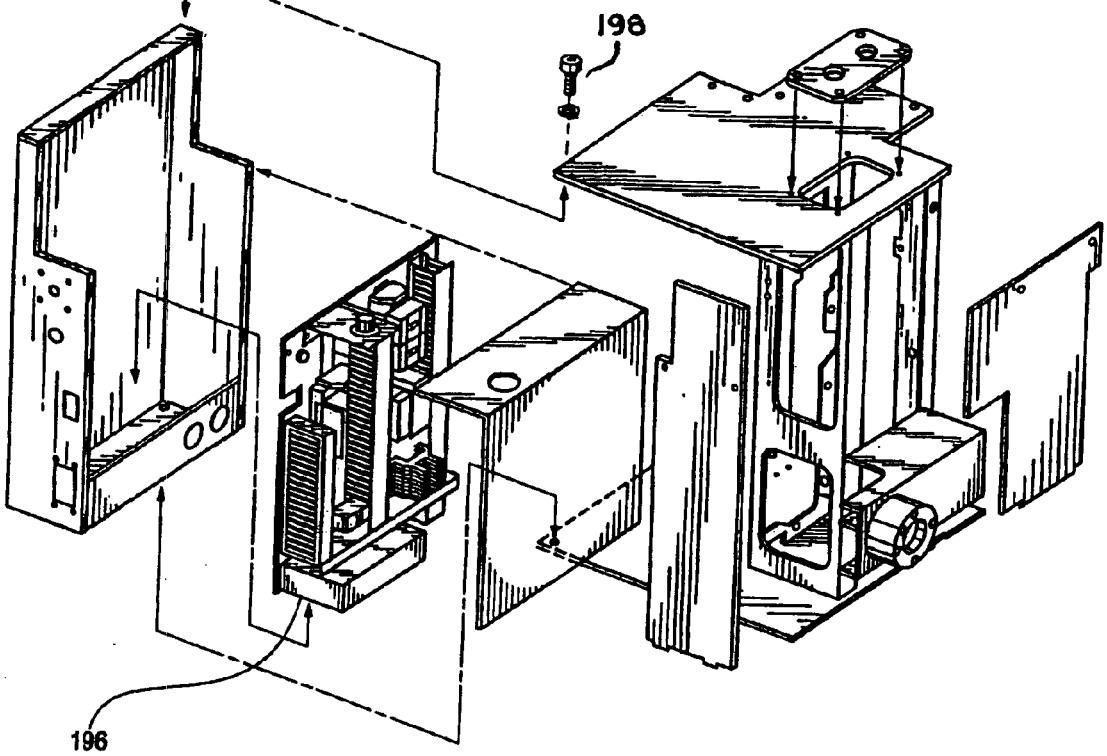
FIG. 6 is an exploded view of the control system enclosure.
Figure 7:
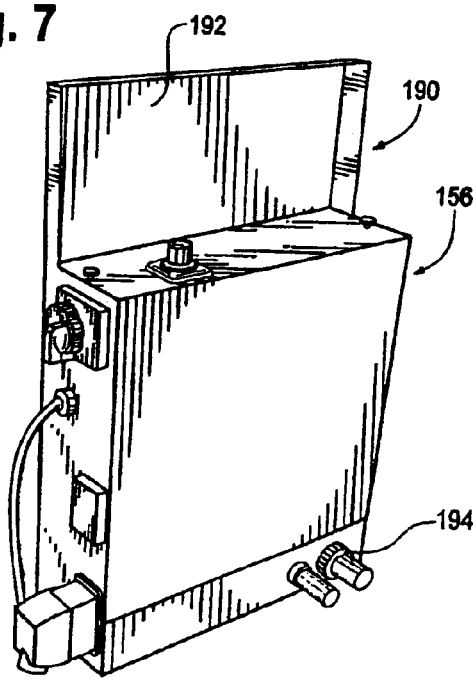
FIG. 7 is a view of the control system enclosure of FIG. 6 assembled.
Figure 8:
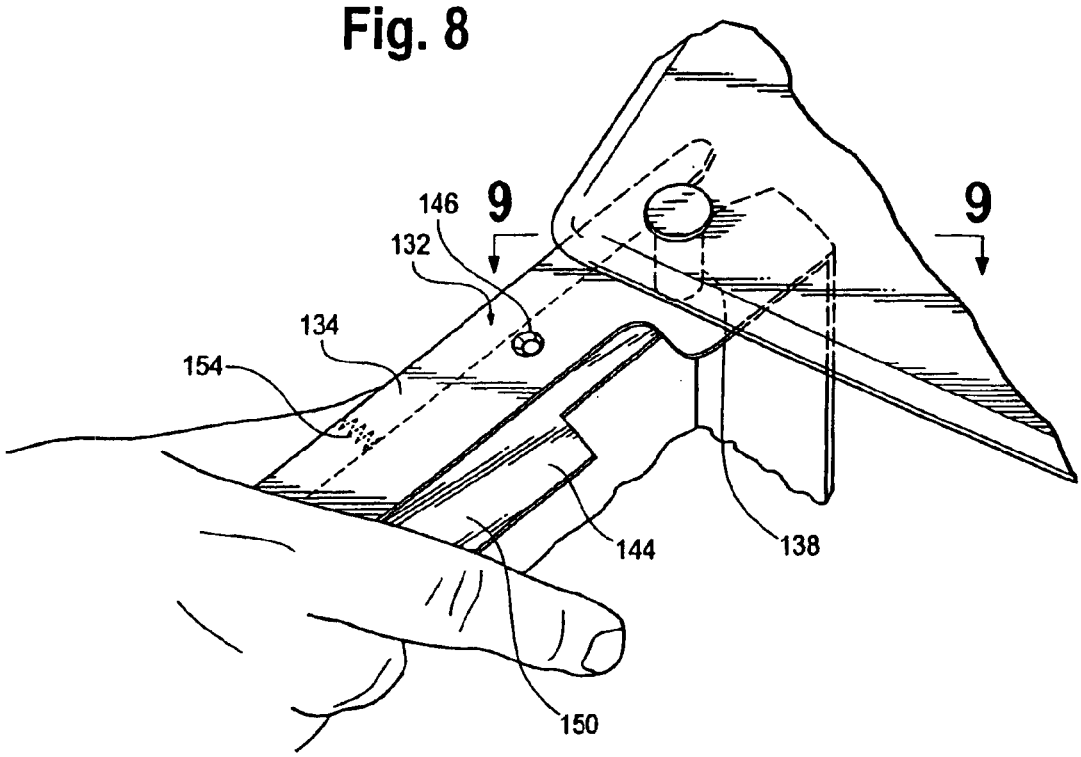
FIG. 8 is a top perspective view of the upper corner of one of the enclosure panels (doors) and the frame, showing the upper hinge pintle and the quick-release latch.
Figure 9:
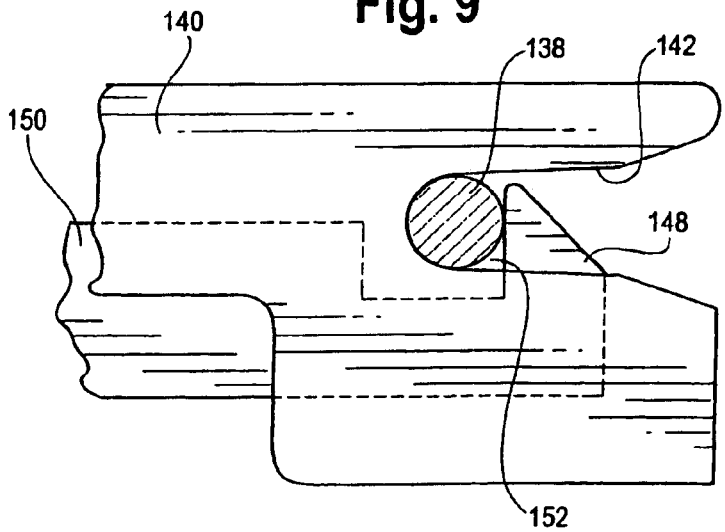
FIG. 9 is a top view of the quick-release latch of FIG. 8.
Figure 10:
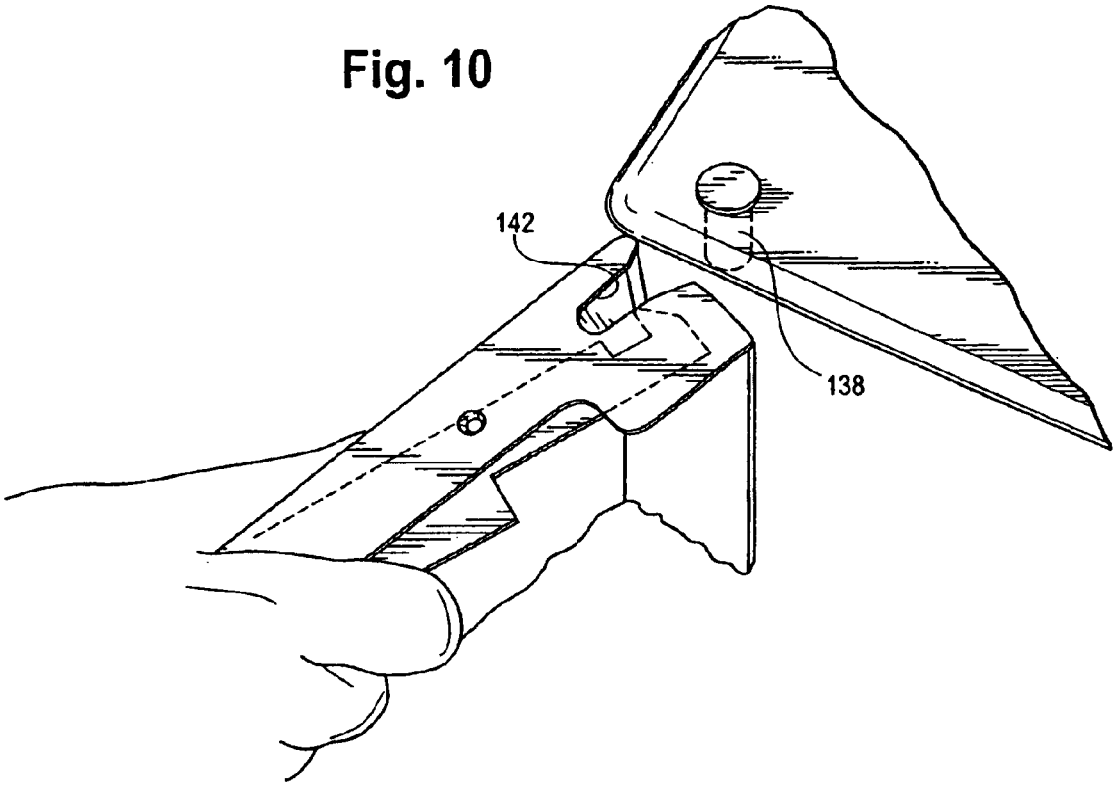
FIG. 10 is a perspective view of the enclosure panel shown with the latch (shown in phantom) in the open position.
Figure 11:
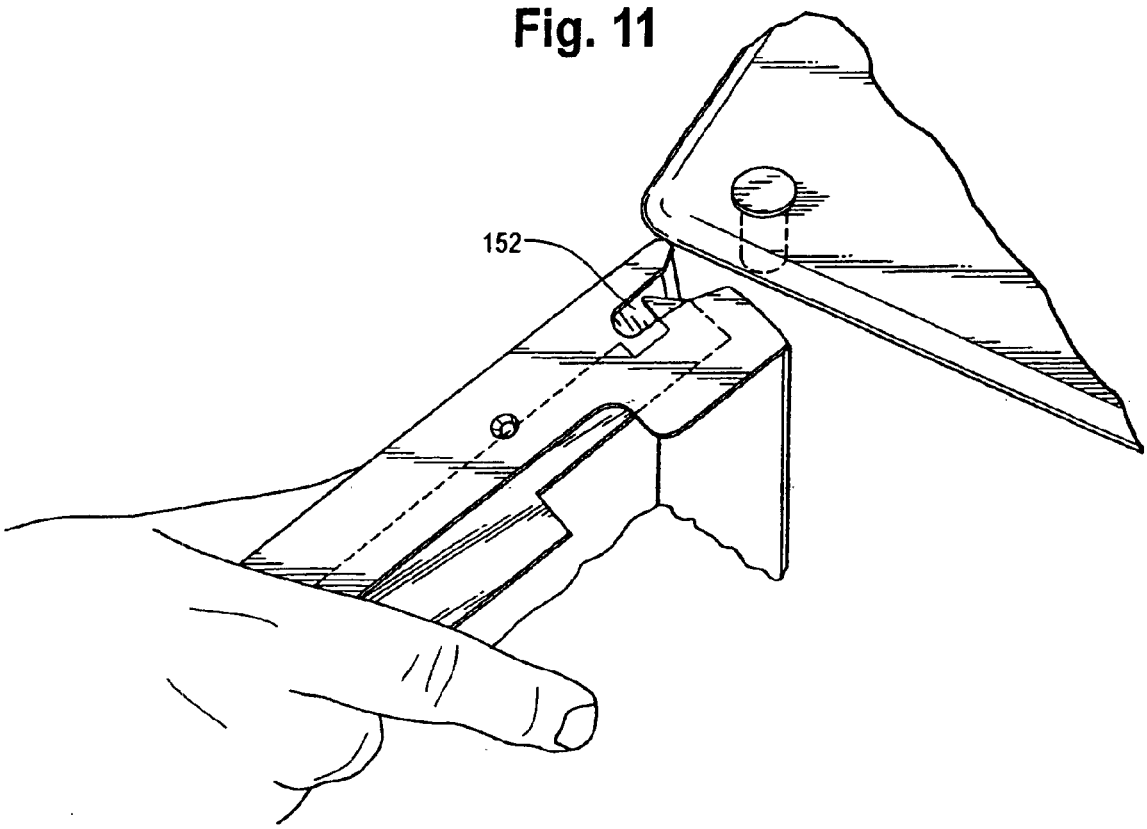
FIG. 11 is a perspective view of the enclosure panel shown with the latch (shown in partial phantom) in the closed position for insertion onto the hinge pintle.
Figure 12:
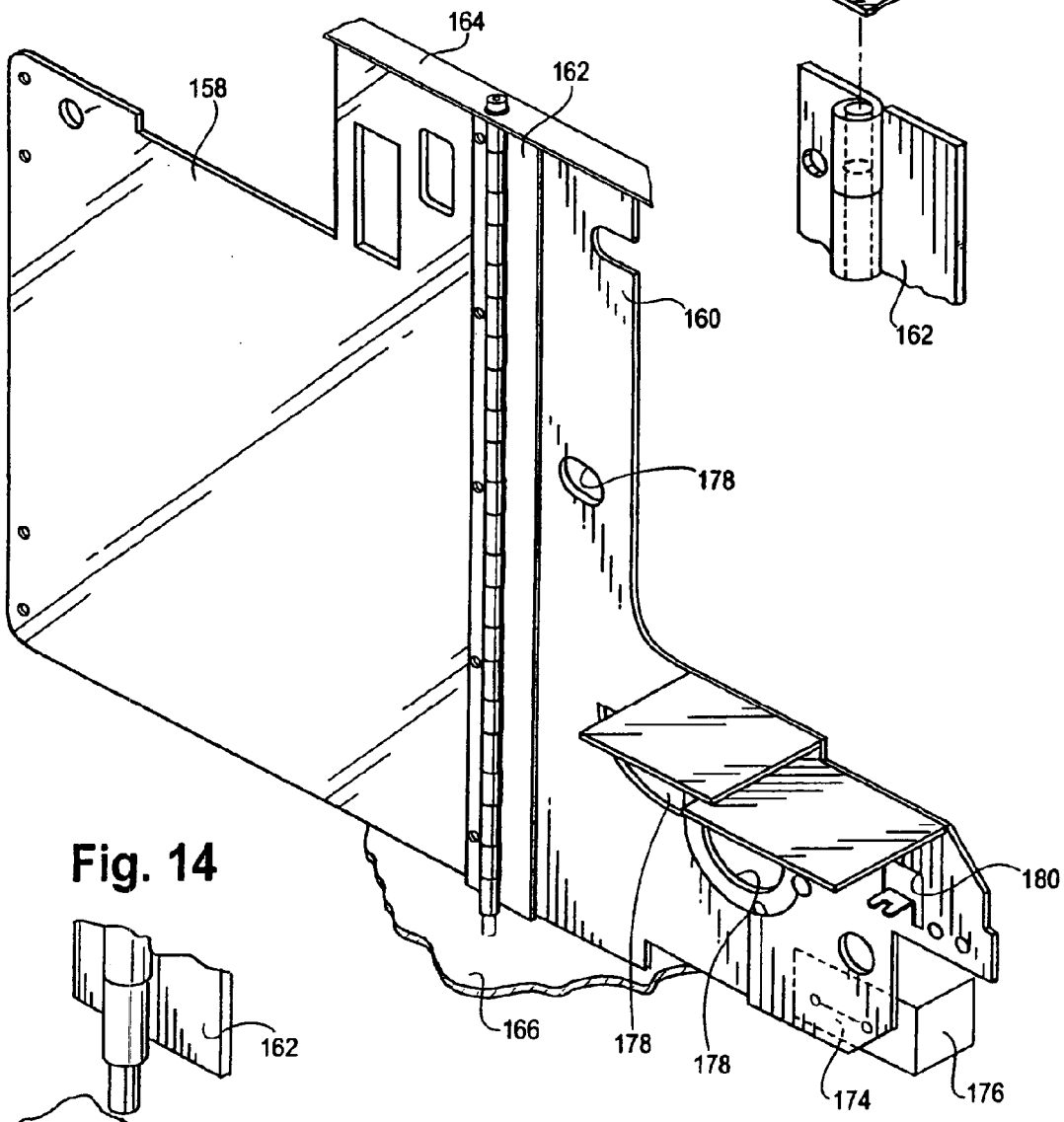
FIG. 12 is a perspective view of a portion of the front of the machine showing the double-hinged slack box and head cover doors, with the slack box door closed and the head cover door closed.
Figure 13:
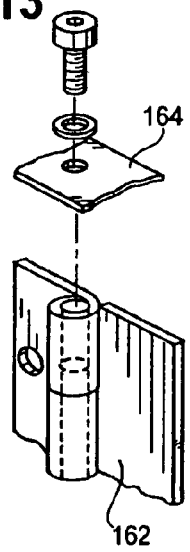
FIG. 13 is a partial view of the bottom of the double-hinged doors.
Figure 14:
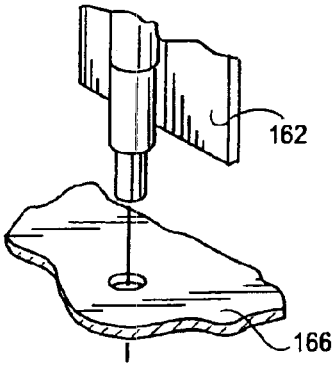
FIG. 14 is a partial view of the top of the double-hinged doors.
Figure 15:
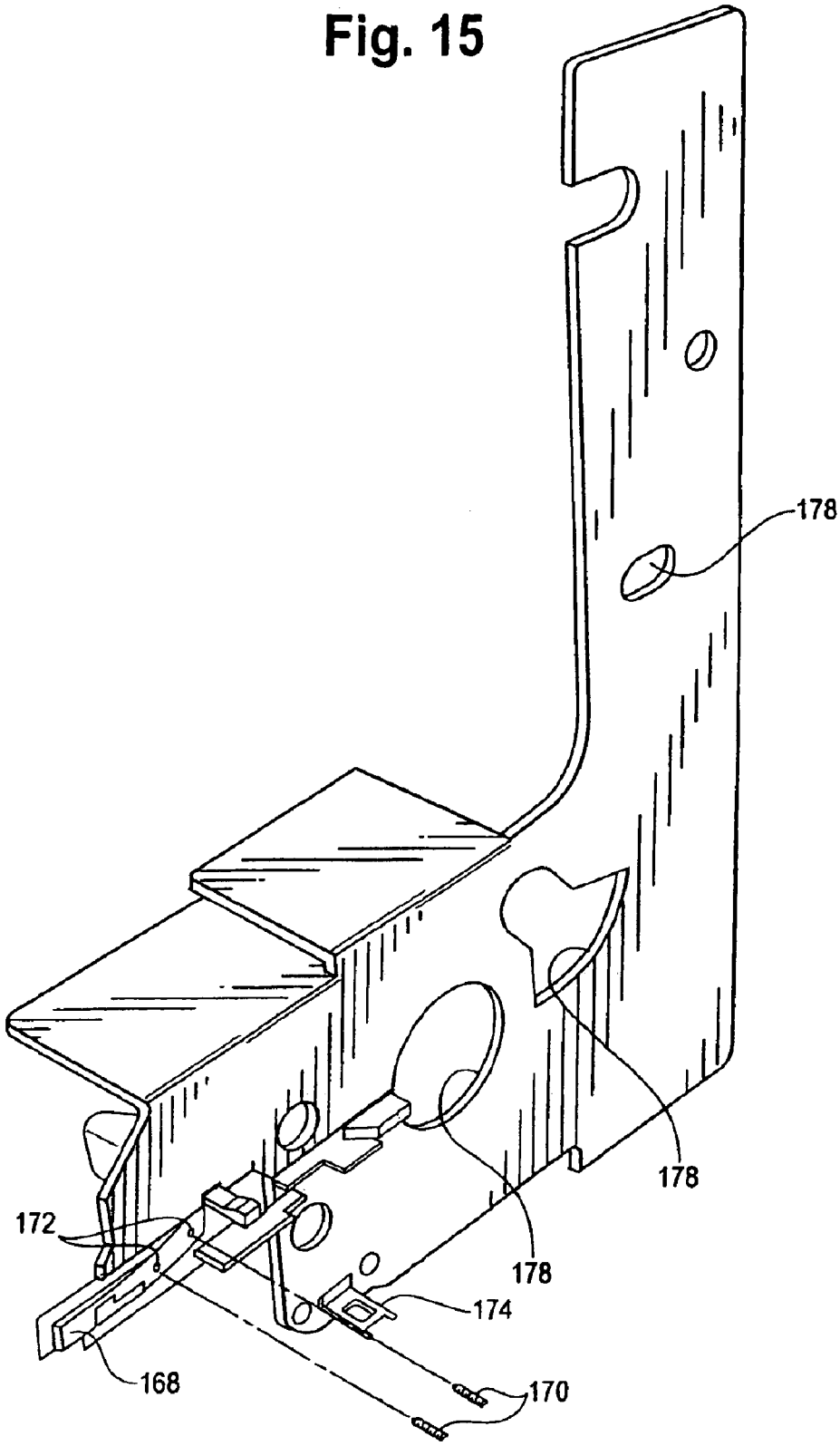
FIG. 15 is a rear view of the head cover door showing the floating strap guide and interlock.
Figure 16:
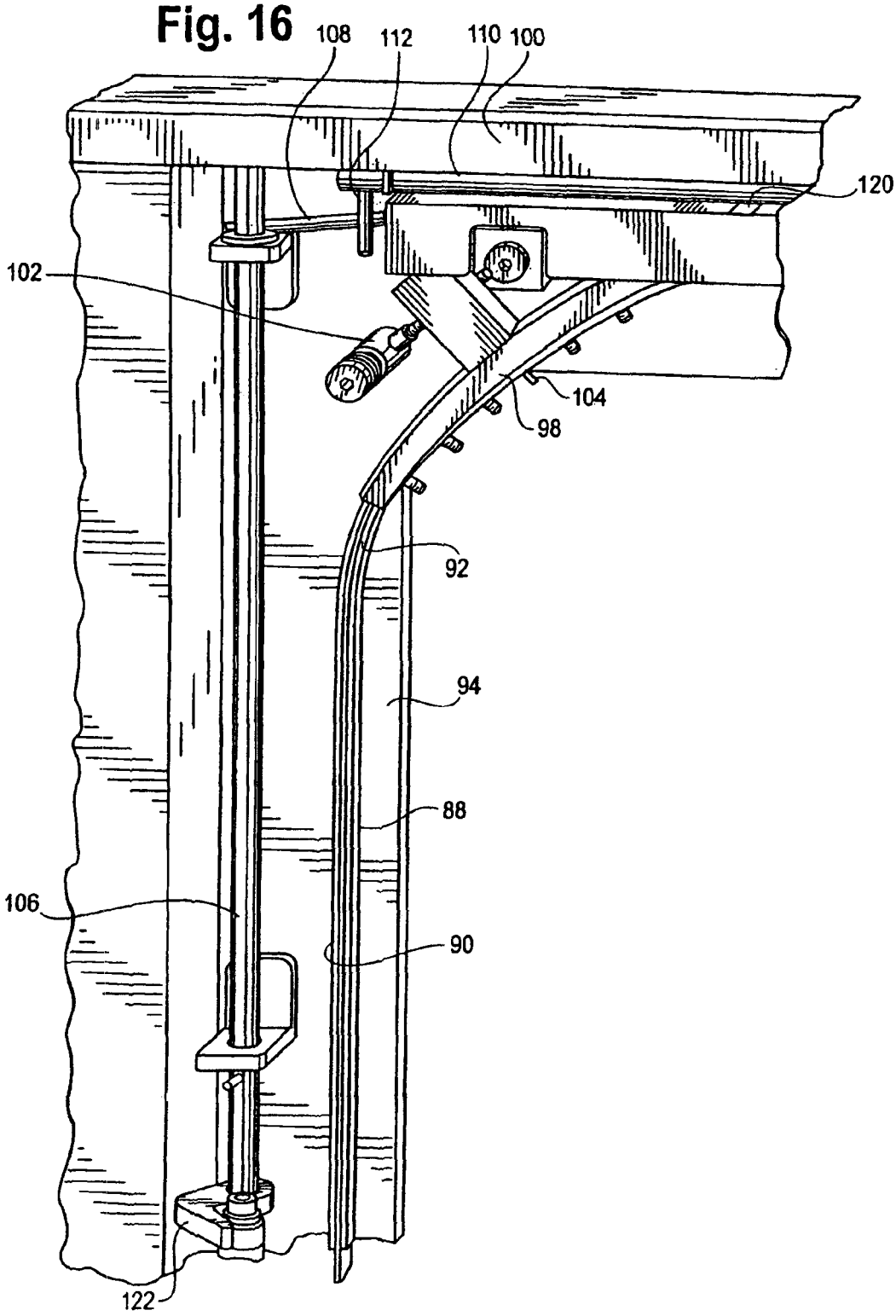
FIG. 16 is a partial perspective view of the strap chute and the first vertical and second horizontal chute release torsion elements, the chute being shown in the closed or track forming position.
Figure 17:
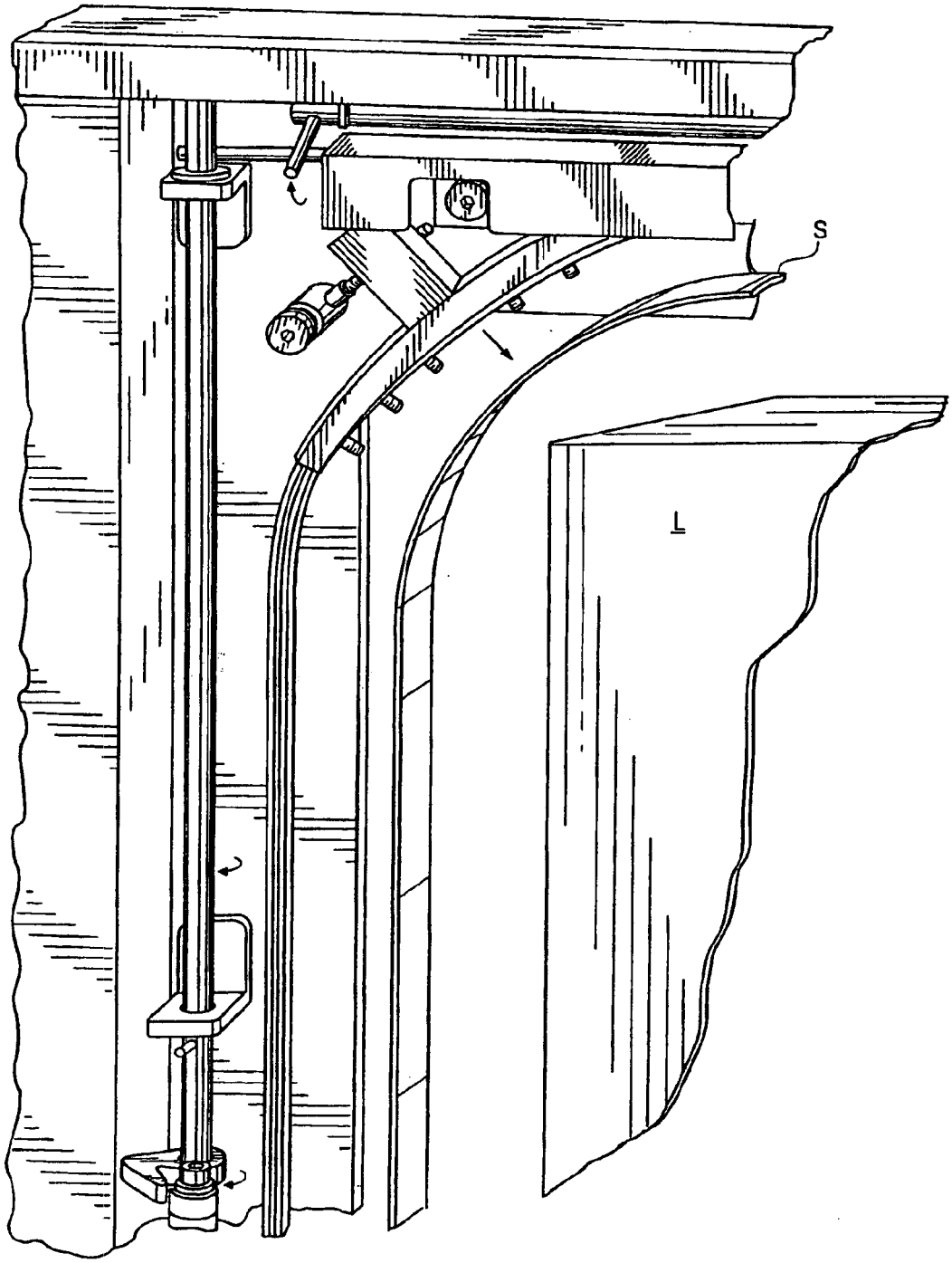
FIG. 17 is a view of the strap chute similar to FIG. 16 showing an article or load to be strapped and showing the chute in the open position and release of the strap material from the chute and travel toward the article.
Figure 18:
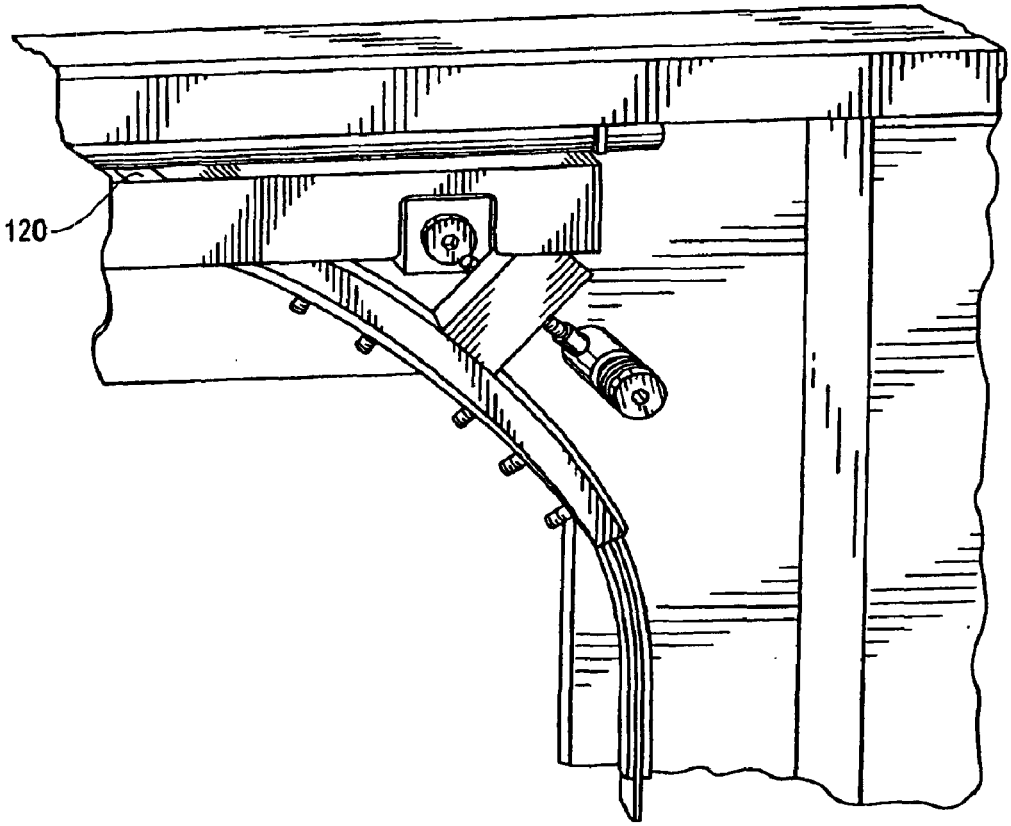
FIG. 18 is a perspective view of an opposite upper corner of the chute.
Figure 19:
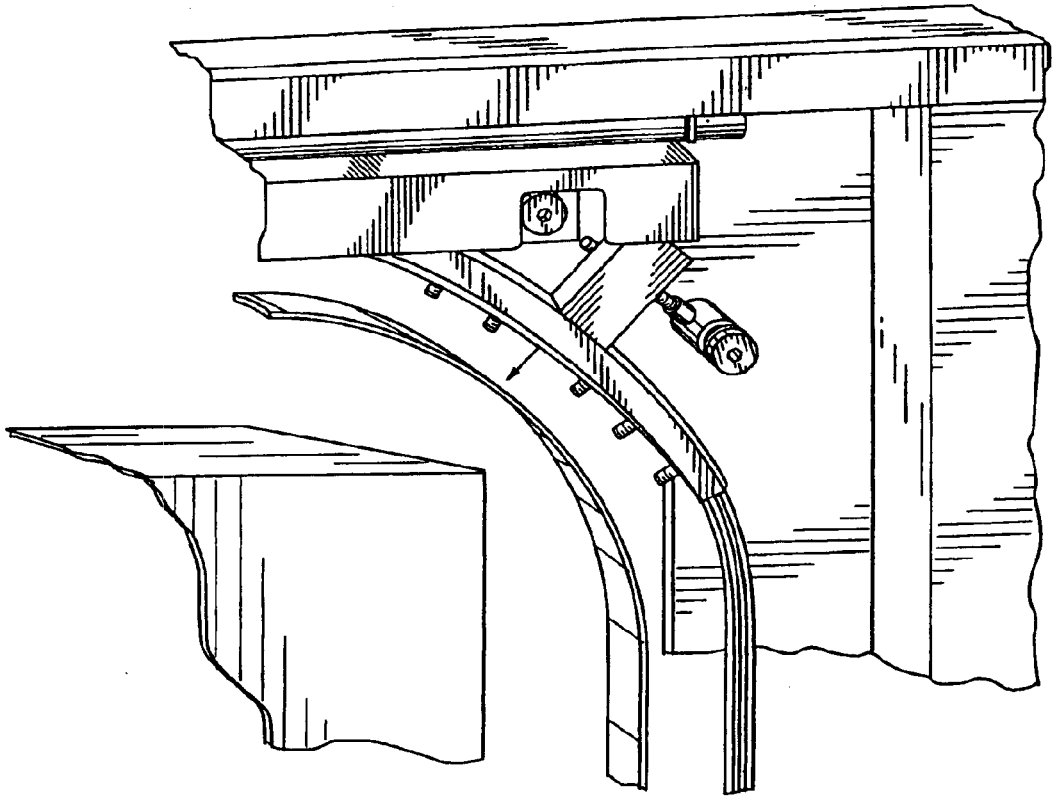
FIG. 19 is a view of the strap chute of FIG. 18 in which the chute is shown open and strap is released from the chute.
Figure 20:
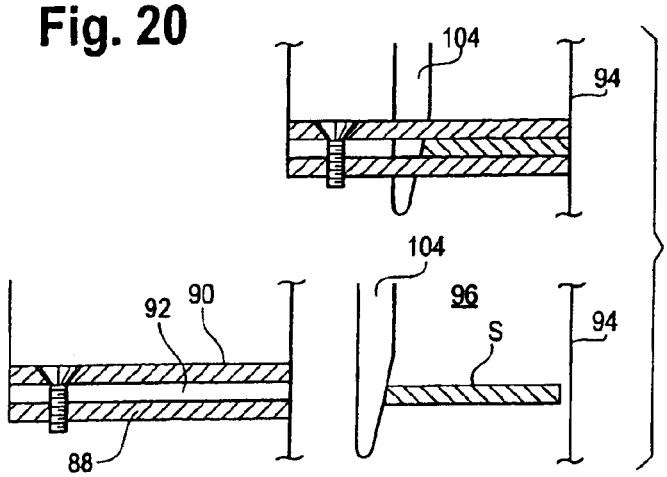
FIG. 20 shows two partial cross-sectional views of the strap chute as it is moved to release the strap from the chute, and showing, schematically, the stripper element for stripping the strap from the chute.
Figure 21:
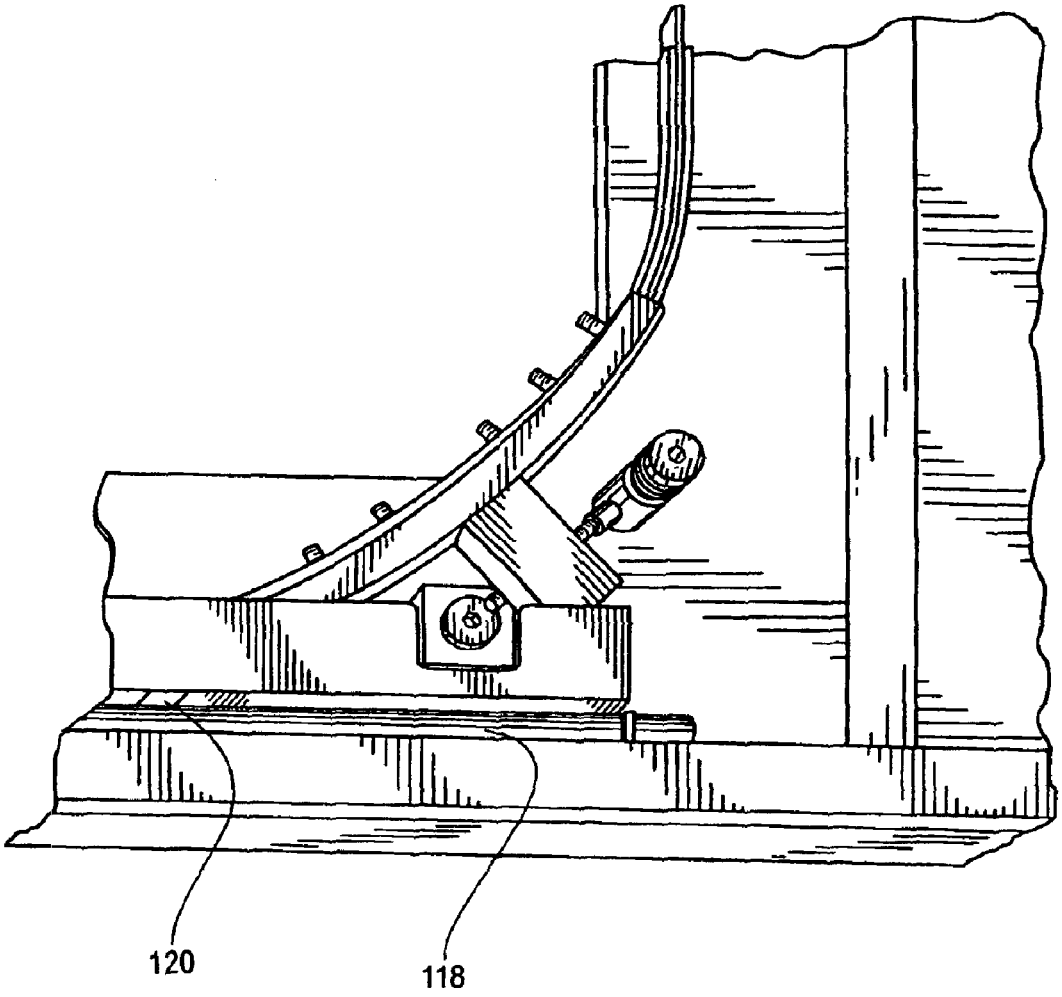
FIG. 21 is a perspective view of a bottom corner of the chute in the closed position.
Figure 22:
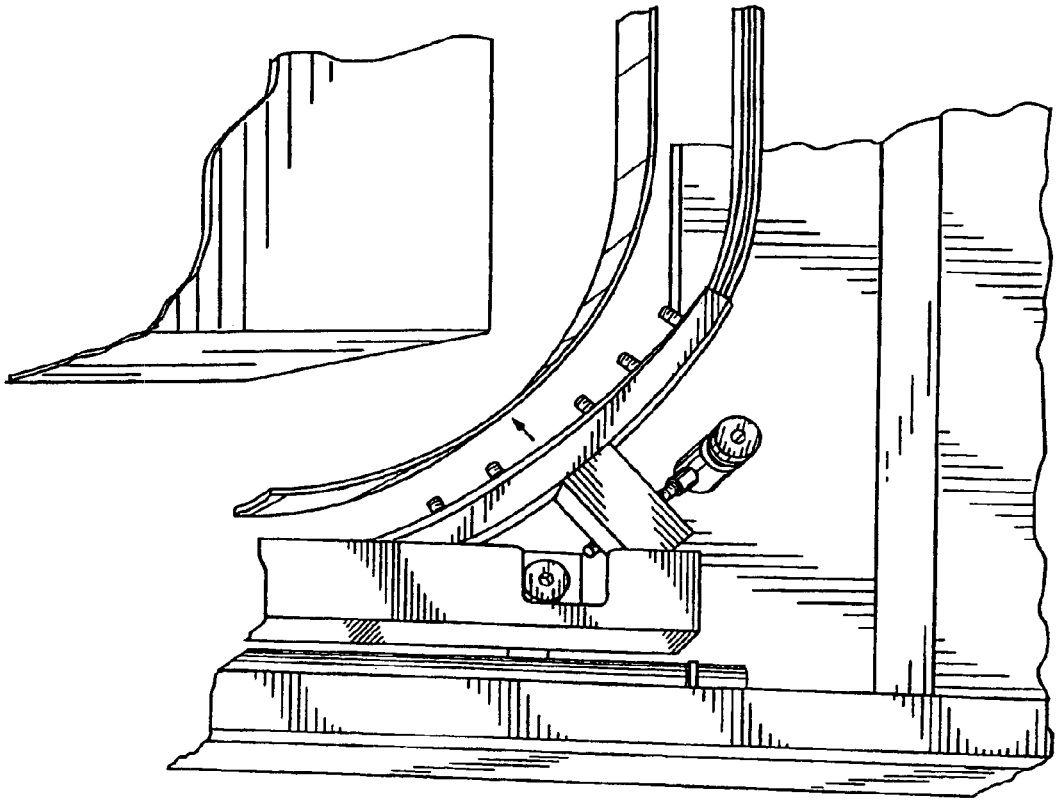
FIG. 22 is a view of the strap chute of FIG. 21 in which the chute is shown open and strap is released from the chute.
Figure 23:
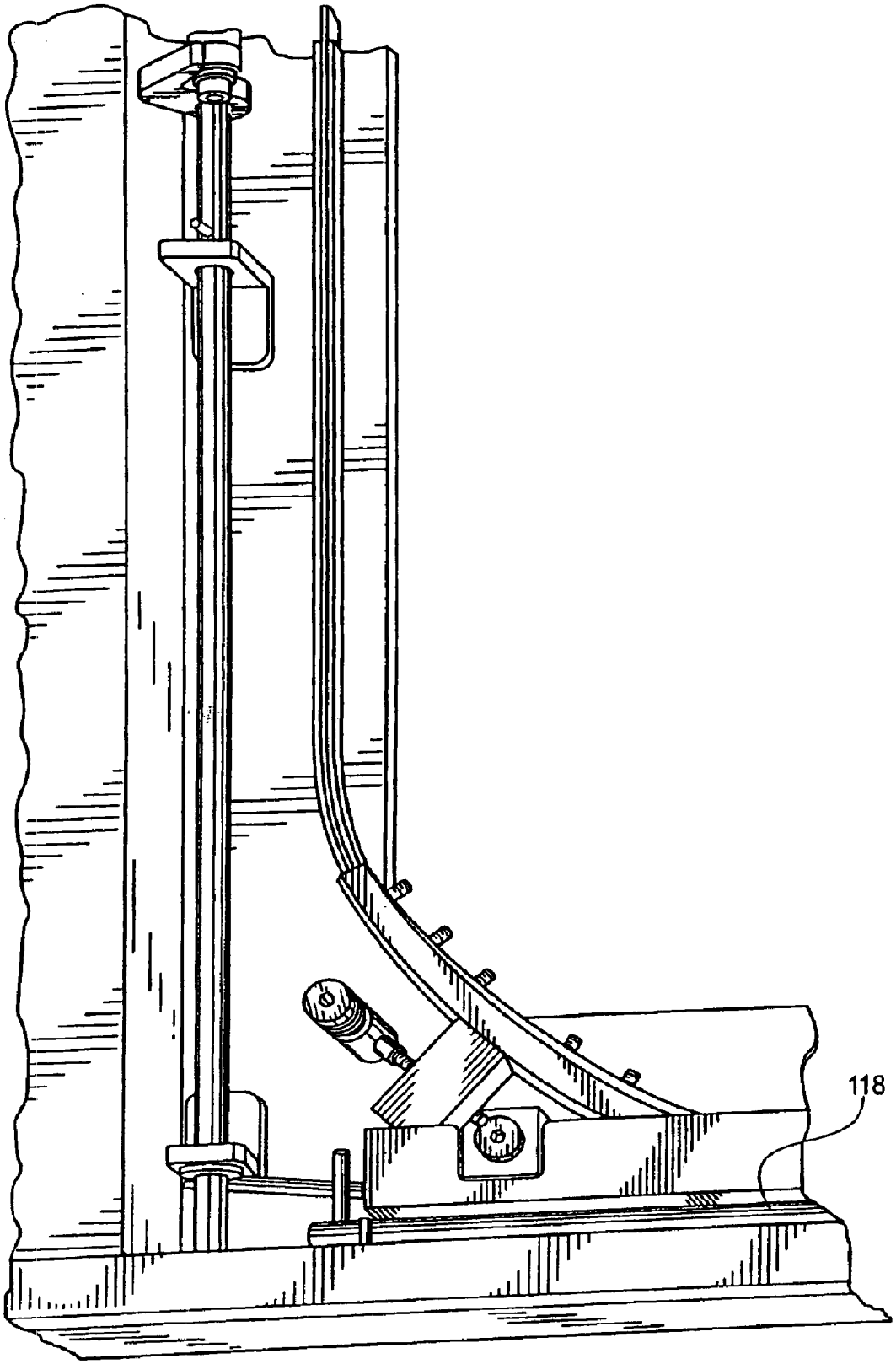
FIG. 23 is a perspective view of the opposite bottom corner of the chute shown in the closed position.
Figure 24:
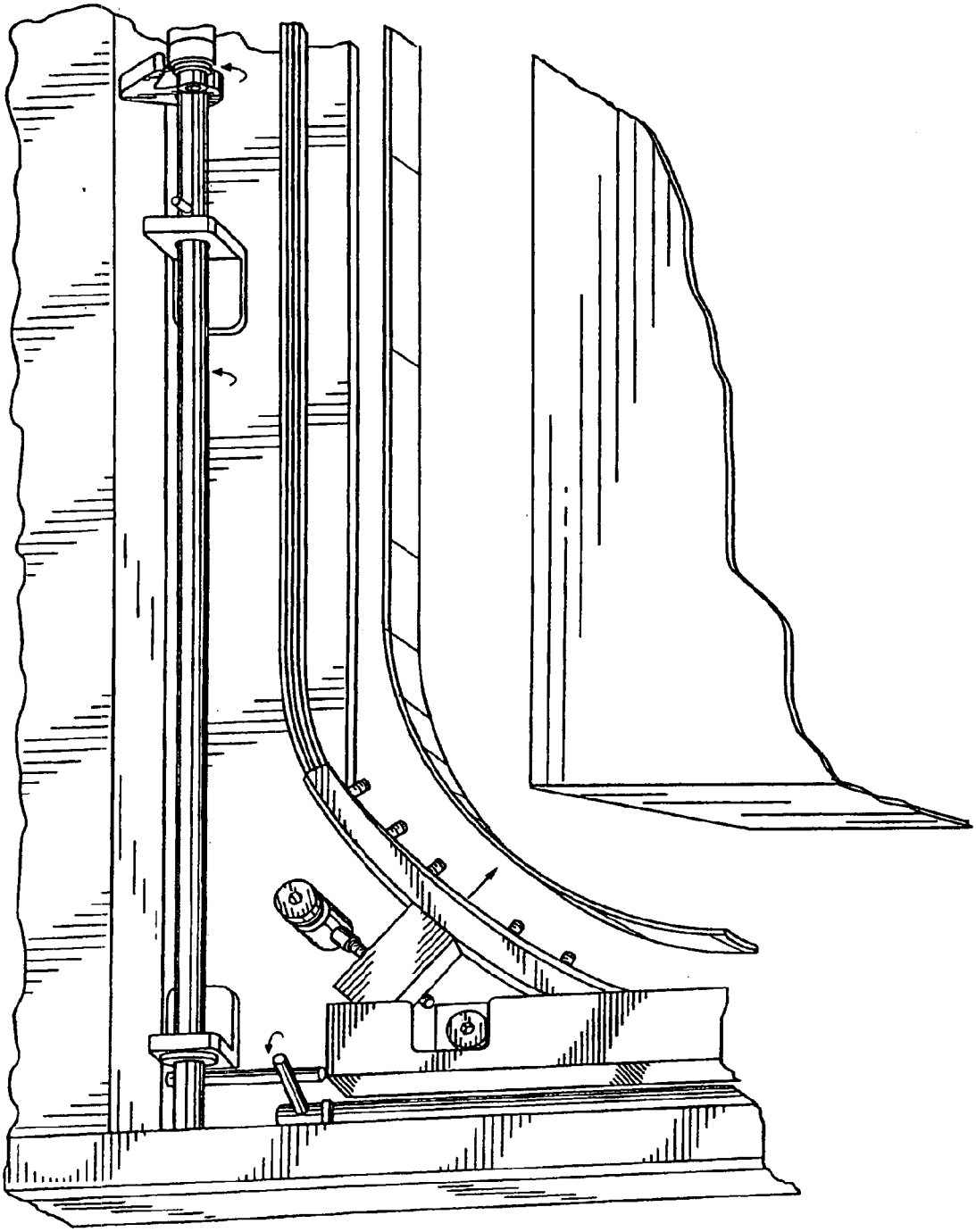
FIG. 24 is a view of the strap chute of FIG. 23 in which the chute is shown open and strap is released from the chute.

Referring now to FIGS. 6 and 7, still another feature that enhances the reduced size and footprint needed for machine operation is a fully enclosed and modularized electronics/control panel 190 for automatic machine 10 operation. The panel 190 is mounted to the machine 10 as a single unit within the electronics enclosure 156. In a present arrangement, the panel 190 is formed as a door 192 for the enclosure 156. Quick-disconnect electrical fittings 194 are used to connect the door-mounted control panel 190 so that the entirety of the control system (e.g., the controller indicated generally at 196) can be carried by the panel or door 190, for ready replacement. Preferably, the panel 190 is mounted to the enclosure 156 using a quick-release latch assembly 132 such as that illustrated in FIGS. 8–11. This arrangement provides for a readily maintainable and serviceable unit that can, if necessary, be readily replaced as needed for continued machine 10 operation.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

What is claimed is:

1. A strapping machine for positioning a strap material around an associated load, tensioning the strap material and sealing the strap material to itself around the load, the strapping machine comprising:

a frame;

a slack box having a slack box cover;

a first portion of strap path having a cover over a portion thereof;

a strapping head mounted to the frame, the strap path cover extending over a portion of the strapping head, the strapping head including a winder for tensioning the strap material around the load;

a chute mounted to the frame and configured for positioning the strap material around the load and to release the strap therefrom to pull the strap material to the load; and at least one enclosure for enclosing a portion of the strap path, the enclosure having a door having a quick-release latch for fully removing the door from the enclosure, the door having a slot therein, the quick release latch having a projection movable across the slot for defining a pintle opening, the projection movable to define a door pivoting position and a door removal position, the latch including a release handle for moving the projection out of the slot to define the door removal position for fully removing the door from the enclosure, the door including a lower hinge pintle engageable with an opening in the frame.

2. The strapping machine in accordance with claim 1 wherein the enclosure door release handle is biased to the move the projection into the slot.

3. The strapping machine in accordance with claim 1 wherein the door release handle for fully removing the door from the enclosure is mounted to an interior surface of the door and is accessible only with the door in an open position.

4. The strapping machine in accordance with claim 1 wherein the door release handle is mounted to an upper lip of the door.

* * * * *